US008867772B2

(12) United States Patent
Akino

(10) Patent No.: US 8,867,772 B2
(45) Date of Patent: Oct. 21, 2014

(54) CONDENSER MICROPHONE UNIT AND CONDENSER MICROPHONE

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 0 days.

(21) Appl. No.: 13/445,524

(22) Filed: Apr. 12, 2012

(65) Prior Publication Data

US 2012/0263332 A1 Oct. 18, 2012

(30) Foreign Application Priority Data

Apr. 14, 2011 (JP) ..... 2011-089909

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 25/00*** | (2006.01) |
| *H04R 31/00* | (2006.01) |

(52) U.S. Cl.

CPC ..... *H04R 19/04* (2013.01); *H04R 31/00* (2013.01)

USPC ..... 381/355; 381/174; 381/175; 381/190; 381/191

(58) Field of Classification Search

CPC ..... H04R 19/04; H04R 3/00; H04R 19/016; H04R 19/02; H04R 19/013; H04R 19/0005; H04R 23/006; H04R 17/00; H04R 2499/11; H04R 15/00; H04R 19/00; H04R 19/01; H04R 1/083; H04R 1/086; H04R 1/08; B81B 2201/0257

USPC ..... 381/113, 116, 174, 175, 190, 191, 355; 29/25.41, 25.42; 438/50, 51, 52; 257/415, 416, 419

See application file for complete search history.

(56) References Cited

U.S. PATENT DOCUMENTS 6,985,597 B2 * 1/2006 Akino ..... 381/174
7,630,506 B2 * 12/2009 Akino ..... 381/174

(Continued)

FOREIGN PATENT DOCUMENTS

JP 1986-187189 * 11/1986 ..... H04R 1/28
JP 1986-187189 U 11/1986

(Continued)

OTHER PUBLICATIONS

John Eagle, The Pressure Microphone, "The Microphone Book", p. 49, Focal Press.

(Continued)

*Primary Examiner* — Matthew Eason
*Assistant Examiner* — Sean H Nguyen
(74) *Attorney, Agent, or Firm* — Manabu Kanesaka

(57) ABSTRACT

To stably obtain high acoustic resistance required for pressure equalization in a non-directional condenser microphone unit. A diaphragm 8 whose circumferential edge is attached to a diaphragm holder 4 and a fixed electrode 6 made of a metal material and arranged to face the diaphragm at a predetermined interval through an electrically insulating spacer 5 are provided, and the rear space of the above-mentioned diaphragm is closed to constitute the non-directional condenser microphone unit. A blind groove 16*a* is formed by an etching process at a portion which is in contact with the spacer 5 and in the fixed electrode 6 so that the rear space between the diaphragm and the fixed electrode may communicate with the outside, and a communication part formed between the groove 16*a* and the spacer 5 may be used as acoustic resistance for pressure equalization.

5 Claims, 7 Drawing Sheets

(56) References Cited

U.S. PATENT DOCUMENTS

| | | | | |
|---|---|---|---|---|
| 7,773,762 | B2 * | 8/2010 | Akino | 381/174 |
| 2008/0205673 | A1 | 8/2008 | Ehrlund | |

FOREIGN PATENT DOCUMENTS

| | | | | | |
|---|---|---|---|---|---|
| JP | H05-145998 | A | | 6/1993 | |
| JP | H09-084195 | | * | 3/1997 | H04R 19/04 |
| JP | 2003-134595 | A | | 5/2003 | |
| JP | 2004-320144 | A | | 11/2004 | |
| JP | 2006-060372 | A | | 3/2006 | |
| JP | 2008-067286 | A | | 3/2008 | |
| JP | 2009-182758 | A | | 8/2009 | |

OTHER PUBLICATIONS

Japan Patent Office, "Office Action for JP 2011-089909," Jul. 9, 2014.

* cited by examiner

CONDENSER MICROPHONE UNIT AND CONDENSER MICROPHONE

BACKGROUND OF THE INVENTION

1. Field of the Invention

The present invention relates to a non-directional condenser microphone in which a rear space behind a diaphragm is substantially sealed, and to a condenser microphone unit and a condenser microphone provided with a pressure equalizing communication passage which prevents the diaphragm from being displaced with changes in atmospheric pressure, for example.

2. Description of the Related Art

A non-directional condenser microphone is fundamentally such that a rear space behind a diaphragm is sealed and the diaphragm is displaced according to a difference between sound pressure applied to a sound terminal outside (in front of) the diaphragm and pressure in the above-mentioned rear space.

This arrangement provides the non-directional microphone which responses only to loudness of sounds regardless of the direction and angle of the diaphragm in the microphone unit.

FIGS. 8 and 9 show an example of the above-mentioned the non-directional condenser microphone unit. FIG. 8 is a sectional view showing a situation where the microphone unit is assembled. FIG. 9 is an exploded sectional view showing the above-mentioned unit, separated into the principal parts.

The condenser microphone unit has a capacitor element in which the diaphragm vibrated by a sound wave and a fixed electrode (back plate) are opposed to each other through an air layer with a predetermined interval, and this capacitor element is assembled in a unit case 1.

That is, the above-mentioned unit case 1 has many sound introduction holes 2 on the front side and is arranged to be in the shape of a cylinder whose rear side is open. This unit case 1 is made of metal materials, such as for example, brass. Into this unit case 1, from its rear side, a front mesh 3, a ring-shaped diaphragm holder 4, a similarly ring-shaped spacer 5, a fixed electrode 6 formed of metal materials, such as brass, and an insulation seat 7 molded from a synthetic resin, etc. are inserted in this order.

Further, a diaphragm 8 vibrated by sound pressure which is applied to a sound terminal is attached to a surface, of the above-mentioned diaphragm holder 4, facing the above-mentioned fixed electrode 6. This diaphragm 8 is arranged to face the above-mentioned fixed electrode 6 through the air layer corresponding to a thickness of the above-mentioned spacer 5 made of a synthetic resin sheet formed in the shape of a ring.

The above-mentioned fixed electrode 6 is supported by the insulation seat 7 so that it may be electrically insulated from the unit case 1 and the diaphragm 8. Further, a pick-up electrode rod 9 for picking up a signal from the above-mentioned fixed electrode 6 is attached to the center of the insulation seat 7.

It should be noted that a cover 10 is attached to the back of the above-mentioned insulation seat 7 in an air-tight manner; air rooms 11 are formed respectively between the insulation seat 7 and the fixed electrode 6 and between the insulation seat 7 and the cover 10, and interconnected through a communication hole 7*a* bored in a proper position of the above-mentioned insulation seat 7.

These air rooms 11 are connected with the rear space behind the diaphragm 8 through communication holes (sound holes: not shown in FIG. 8 or 9) formed in the above-mentioned fixed electrode 6.

Further, a lock ring 12 is screwed into the rear of the unit case 1 using a female screw formed in the inner periphery of the unit case 1. This lock ring 12 applies predetermined pressure to the fixed electrode 6 through the insulation seat 7 towards the diaphragm holder 4. All the unit components including the diaphragm holder 4 and the fixed electrode 6 are fixed in the unit case 1.

It should be noted that, as with the unit case 1, the above-mentioned lock ring 12 is formed of metal materials, such as brass, for example.

According to the above-mentioned microphone unit (shown by the same reference numeral 1 as that for the unit case), the diaphragm 8 is held by the above-mentioned diaphragm holder 4 at the front of the above-mentioned unit case 1 in the air-tight manner. Thus, as the atmospheric pressure applied to the sound terminal at the front of the diaphragm 8 changes, the diaphragm 8 is displaced according to an atmospheric pressure difference between a space in front of the diaphragm 8 and the rear space including the above-mentioned air room 11. It follows that output sensitivity of the microphone unit 1 changes with the displacement of this diaphragm 8.

In order to prevent the diaphragm displacement caused by such changes in atmospheric pressure, a structure of the condenser microphone provided with a communication passage referred to as a capillary vent (Capillary vent) which allows the rear space (including the above-mentioned air room 11) of the diaphragm to communicate with the outside at a frequency band which is much lower than a sound-collecting frequency band is disclosed by John Eargle, The Microphone Book: (Focal Press), p 49, Figures. 3-20.

Preventing the displacement of the diaphragm caused by change in atmospheric pressure as described above is referred to as "pressure equalization". As to the pressure equalization, it is necessary for the communication to be carried out at a frequency much lower than the sound collecting frequency band, and it is necessary for the air room to communicate with the open air at a higher acoustic impedance than an acoustic impedance of the air room.

In order to stably obtain high acoustic resistance, a thin pipe (capillary tube) or a thin air layer resistor surrounded by plates is used. Each of these needs a micro fabrication in order to obtain a high impedance, and high cost is unavoidable in order to maintain suitable processing accuracy.

Incidentally, in this type of condenser microphone unit, a structure is employed in which a ring-shaped spacer made of a synthetic resin is interposed between the diaphragm and the perimeter of the fixed electrode so that a diaphragm assembly is attached. FIGS. 10 to 12 illustrate an example of the structure.

It should be noted that, in FIGS. 10 to 12, parts which function similarly to those illustrated in FIGS. 8 and 9 above are denoted by the same reference signs. Accordingly, the description of these parts will not be repeated herein.

FIG. 10 is a sectional view showing a situation where the microphone unit is assembled similarly to the FIG. 8 situation, FIG. 11 is an enlarged sectional view showing a portion indicated by reference sign b in FIG. 10, and FIG. 12 is a front view showing an arrangement of the spacer used in the microphone unit as shown in FIG. 10.

In the microphone unit shown in FIGS. 10 to 12, the spacer 5 with the arrangement shown in FIG. 12 is used. That is, a part of the ring is excised, and the spacer 5 shown in FIG. 12 is arranged such that this excised part 5*a* may function as an atmospheric gas communication passage (acoustic resistance).

Its feature is expanded and shown in FIG. 12. The expanded sectional view shown in FIG. 11 illustrates the portion including the excised part 5*a* in the above-mentioned spacer 5.

In addition, in this example, as shown in FIG. 11, a mesh-like spacer (stainless steel mesh) 14 which is obtained by using a stainless steel material (for example) and processing it into the shape of a mesh is arranged at the front side of the diaphragm holder 4.

Being processed in the shape of a mesh, this mesh-like spacer 14 has an air permeability and is formed in the shape of a ring as described above.

According to the above-mentioned arrangement, the communication passage (acoustic resistance) of the excised part 5*a* cut off at the above-mentioned spacer 5 is formed at a part of a place where the circumferential edge of the above-mentioned diaphragm 8 and the above-mentioned fixed electrode 6 face each other.

Thus, as shown by a dotted line arrow in FIG. 11, the rear space between the diaphragm 8 and the fixed electrode 6 communicates with the inner periphery side of the unit case 1 through the excised part 5*a* of the above-mentioned spacer 5, and it further communicates with the above-mentioned mesh-like spacer 14 side through a gap between the inner periphery of the unit case 1 and a perimeter edge of the diaphragm holder 4, thus being connected with the outside.

According to the microphone unit 1 shown in FIGS. 10 to 12, since the excised part 5*a* is formed at the spacer 5 so as to be C-shaped, there is a problem in that the spacer 5 tends to be easily transformed when assembled, leading to variations in width of the excised part 5*a* particularly and to difficulty in obtaining stable acoustic resistance.

Then, the applicant has proposed an arrangement of a spacer, a part of which is provided with a rebated groove, without cutting the spacer to be C-shaped as described above. This is disclosed in Japanese Utility Model Application Publication No. S61-187189. According to this, it needs a process of forming an annular groove and a sound introduction groove communicating therewith on a diaphragm holder side where the diaphragm is attached.

Further, the applicant has proposed a device in which a hole is bored by way of spark discharge at a part of the diaphragm made of a resin and pressure equalization is carried out using the hole. This is disclosed in Japanese Patent Application Publication No. H9-84195.

According to this, since a thickness of the film-like diaphragm is as thin as around 2 μm, a problem arises in that it is difficult to obtain very high acoustic resistance required for the non-directional condenser microphone in the case of attempting to apply the device disclosed in Japanese Patent Application Publication No. H9-84195 to the non-directional condenser microphone.

SUMMARY OF THE INVENTION

The present invention arises in view of the above-described technical background, a blind groove is formed by an etching process at a portion which is in contact with a spacer and in a fixed electrode, and the groove is used as acoustic resistance for pressure equalization.

That is, since the above-mentioned etching process allows the groove to have a very shallow depth and to be formed with sufficient accuracy, the present invention particularly aims to providing a condenser microphone unit and a condenser microphone which can stably obtain very high acoustic resistance for pressure equalization required for a non-directional condenser microphone.

The condenser microphone unit in accordance with the present invention made in order to solve the above-mentioned problems is a non-directional condenser microphone unit having a diaphragm whose circumferential edge is attached to a diaphragm holder and a fixed electrode made of a metal material and arranged to face the above-mentioned diaphragm at a predetermined interval through an insulating spacer, wherein the rear space of the above-mentioned diaphragm is closed, a blind groove is formed by an etching process at a portion which is in contact with the above-mentioned spacer and in the above-mentioned fixed electrode so that the rear space between the above-mentioned diaphragm and the fixed electrode may communicate with the outside, and a communication part formed between the above-mentioned groove and the above-mentioned spacer may serve as acoustic resistance for pressure equalization.

In this case, it is preferable that the above-mentioned fixed electrode is provided with a communication hole which allows communication between the arrangement side of the above-mentioned diaphragm and the other side, closed air rooms interconnected through the above-mentioned communication hole are formed on the other side opposite the diaphragm arranged side of the above-mentioned fixed electrode, and the rear space of the above-mentioned diaphragm is arranged to include the above-mentioned air rooms.

In a preferred embodiment, it is arranged that the blind groove formed in the above-mentioned fixed electrode by the etching process is constituted by an annular groove formed in a position covered with the above-mentioned spacer and a first groove and a second groove formed at 180 degrees diametrically opposed positions of the above-mentioned the annular groove, the first groove extends outwardly from the above-mentioned the annular groove and allows communication between the above-mentioned the annular groove and the outside, and the second groove extends inwardly from the above-mentioned the annular groove and allows communication between the above-mentioned the annular groove and the rear room of the diaphragm.

Further, the condenser microphone unit having the above-described arrangement is mounted in the microphone case and arranged to pick up a sound signal generated in the above-mentioned condenser microphone unit, thus constituting the condenser microphone.

According to the condenser microphone unit with the arrangement described above, it is arranged that the blind groove is formed by the etching process (half etching process) at the portion which is in contact with the spacer and in the fixed electrode, so that the rear space between the diaphragm and the fixed electrode may communicate with the outside, and a communication part formed between this groove and the above-mentioned spacer may be used as acoustic resistance for pressure equalization.

That is, according to the above-mentioned etching process (half etching process), the very shallow blind groove having an etched depth of around 5 μm can be formed in the metal fixed electrode with sufficient accuracy, and it is possible to set up its lengths and width arbitrarily.

Therefore, a lower limit frequency of collecting sounds can be set up appropriately. Further, since dimensional stability when processing the groove is good, it is possible to provide stable acoustic resistance, to thereby prevent variations in the limit frequency of collecting sounds.

DESCRIPTION OF THE PREFERRED EMBODIMENTS

Figure 8:
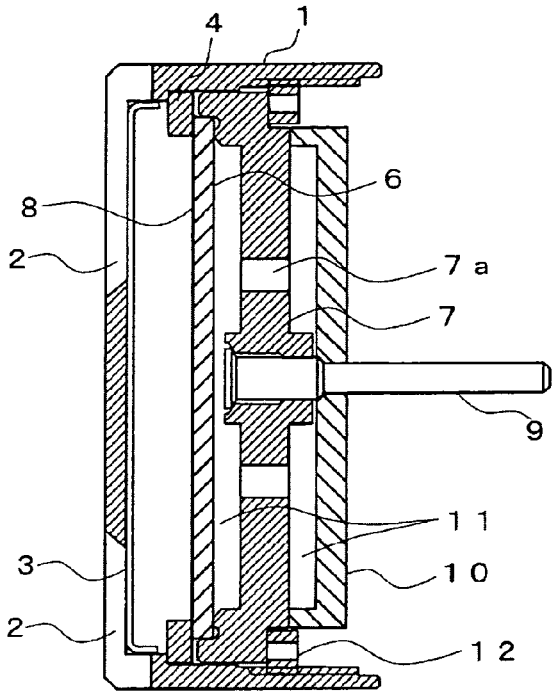
FIG. 8 is a vertical sectional view showing an example of an arrangement of a conventional non-directional microphone unit.
Figure 9:
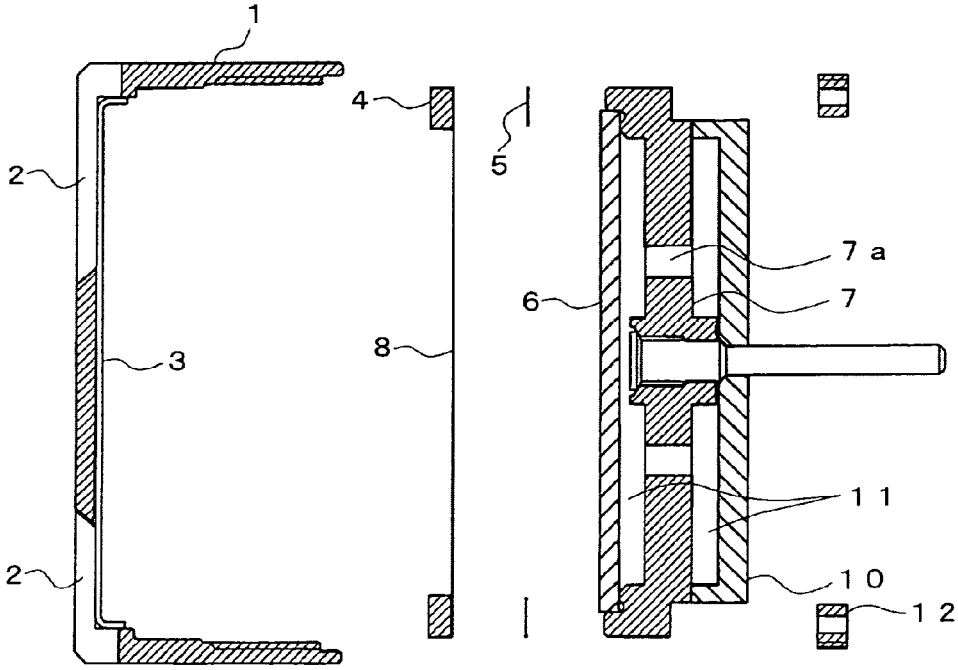
FIG. 9 is an exploded sectional view showing the microphone unit shown in FIG. 8 and separated into the principal parts.
Figure 10:
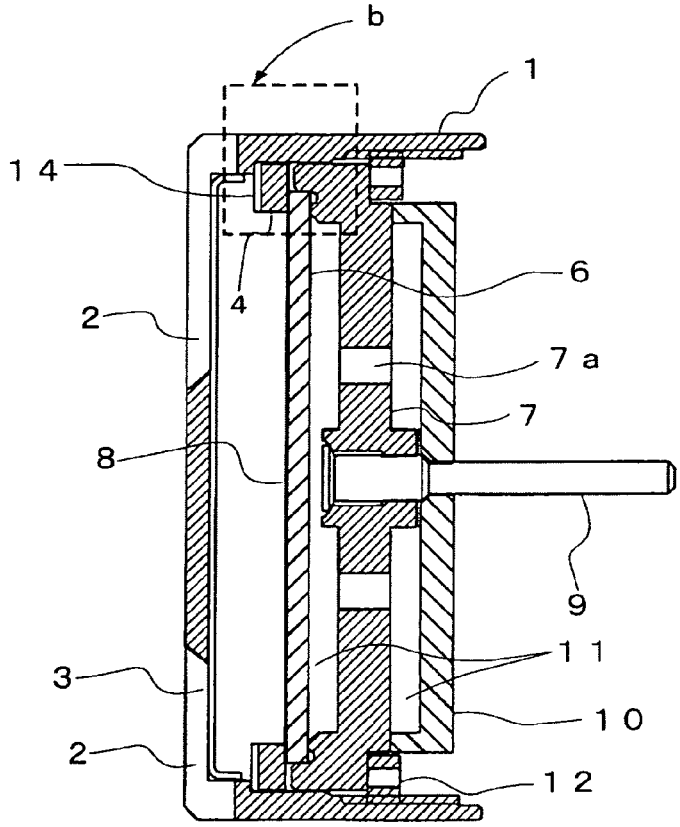
FIG. 10 is a vertical sectional view showing an arrangement of the conventional non-directional microphone unit provided with a pressure equalization means.

Hereinafter, a condenser microphone unit and a condenser microphone in accordance with the present invention will be described with reference to a first preferred embodiment shown in FIGS. 1 to 4 and a second preferred embodiment shown in FIGS. 5 and 6. It should be noted that in FIGS. 1 to 6, parts which function similarly to those illustrated in FIGS. 8 and 9 above are denoted by the same reference signs. Accordingly, the description of these parts will not be repeated herein.

Figure 1:
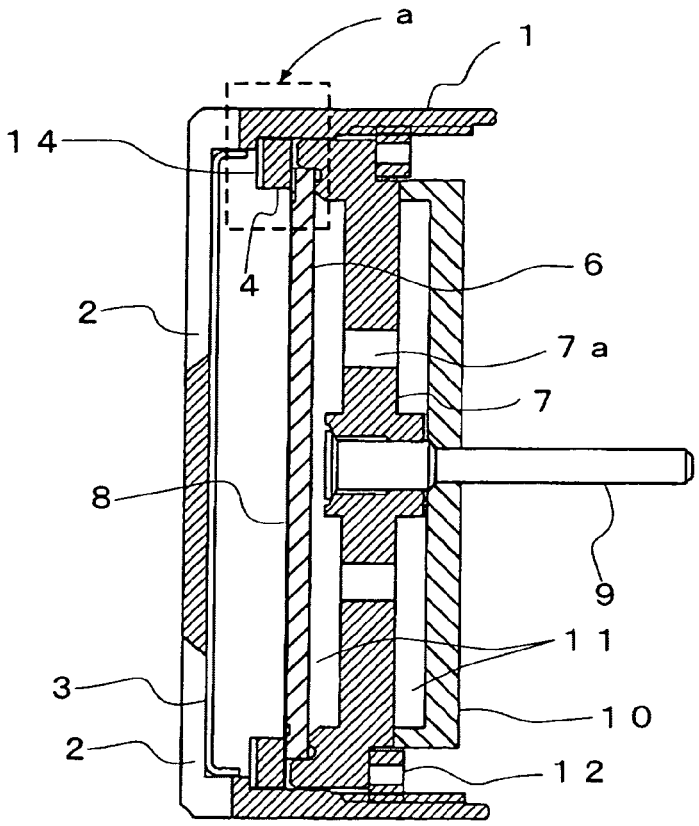
FIG. 1 is a vertical sectional view showing an arrangement of a condenser microphone unit in accordance with the present invention.
Figure 2:
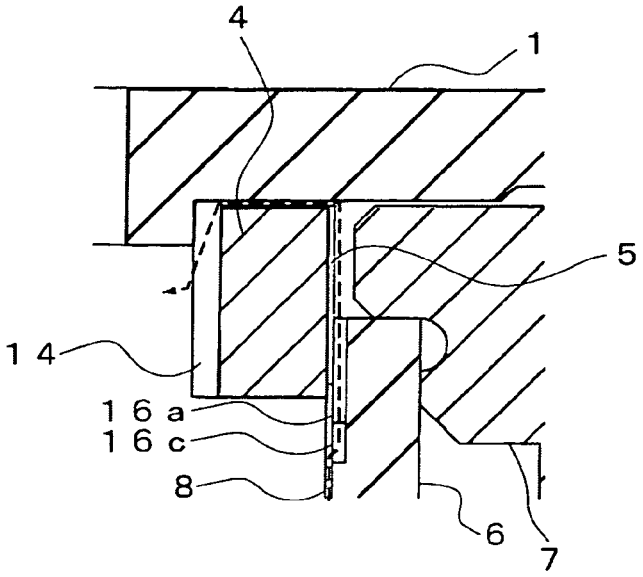
FIG. 2 is an expanded sectional view of a portion "a" surrounded by a dotted line frame in FIG. 1.
Figure 3:
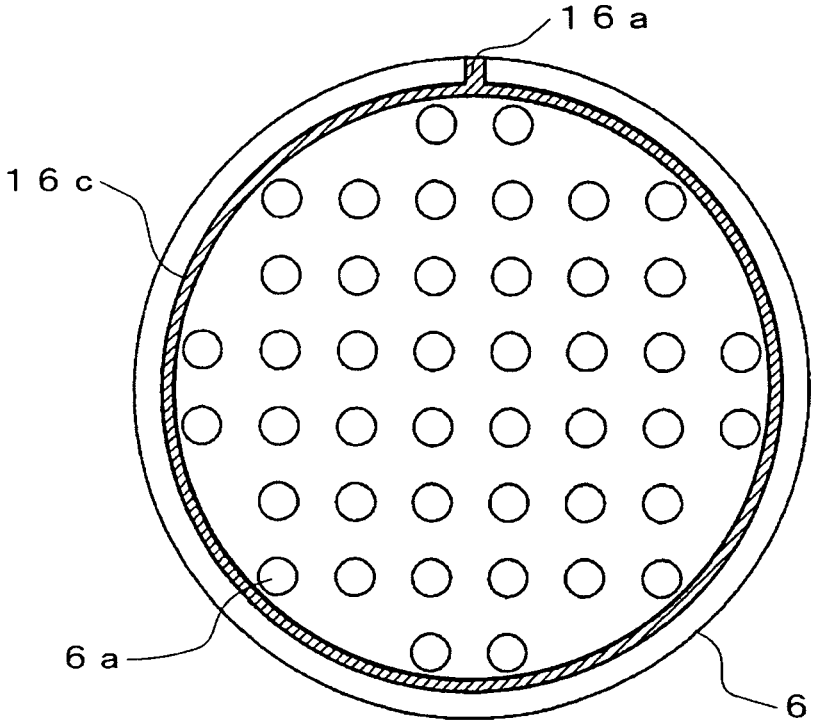
FIG. 3 is a front view of a fixed electrode used for the microphone unit shown in FIG. 1.

In the first preferred embodiment of the condenser microphone unit in accordance with the present invention shown in FIGS. 1 to 4, a blind groove is formed by an etching process on one surface of a fixed electrode 6 which is formed in the shape of a disk and made of a metal material, such as for example brass. That is, a blind groove 16*a* processed by etching is formed in the shape of a straight line at a portion which is in contact with a spacer 5 and in a perimeter edge of the above-mentioned fixed electrode 6 as shown in FIG. 3.

In addition, in this preferred embodiment, a blind annular groove 16*c* is formed by an etching process concentrically with the perimeter edge of the fixed electrode 6 and a part of this annular groove 16*c* allows communication with the above-mentioned straight line groove 16*a*.

It should be noted that as the above-mentioned grooves 16*a* and 16*c* are formed on one surface side of the fixed electrode 6 by the etching process, when forming the above-mentioned grooves on one surface side of the fixed electrode 6, a portion except for positions to be formed as the above-mentioned grooves 16*a* and 16*c* is covered with a photoresist agent, and an engraving process is performed only for the positions to be formed as the above-mentioned grooves on one surface side of the fixed electrode 6 by means of an etching solution etc.

A process of thus etching one side of a material is also called a "half etching process".

Figure 4:
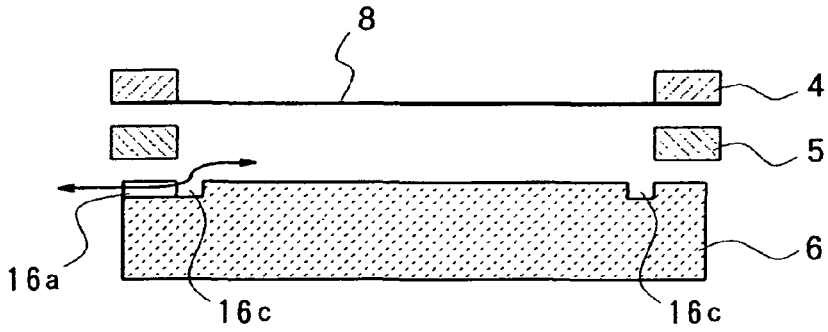
FIG. 4 is a schematic section showing a relationship between the fixed electrode and a diaphragm through a spacer in the microphone unit shown in FIG. 1.

FIG. 4 schematically shows a situation where the ring-shaped spacer 5 is stacked on the fixed electrode 6 having formed thereon the above-mentioned grooves 16*a* and 16*c*, and the ring-shaped diaphragm holder 4 having mounted thereon the diaphragm 8 is further stacked in order.

At the portion which is in contact with the spacer 5 and in the above-mentioned fixed electrode 6, the communication part is constituted by the grooves 16*a* and 16*c* formed by the above-mentioned half etching process and the above-mentioned spacer 5 which covers the groove as shown by a solid line arrow.

That is, at the above-mentioned communication part shown by the solid line arrow, the rear space between the above-mentioned diaphragm 8 and the fixed electrode 6 functions to communicate with the outside.

In this case, the grooves 16*a* and 16*c* are formed as very shallow blind grooves having an etched depth of around 5 μm by the above-mentioned half etching process. These grooves can be formed with sufficient accuracy, and it is possible to set up their lengths and widths arbitrarily.

Therefore, the above-mentioned communication part can be effectively operated as acoustic resistance for pressure equalization in the non-directional microphone unit.

The unit including the fixed electrode 6 provided with the above-mentioned communication part for pressure equalization (acoustic resistance) and the diaphragm 8 is arranged in the unit case 1 as shown in FIGS. 1 and 2.

Figure 11:
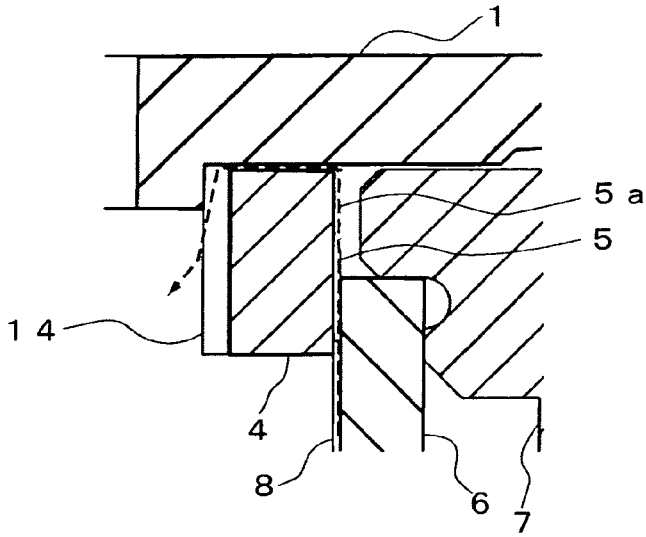
FIG. 11 is an expanded sectional view of a portion "b" surrounded by a dotted line frame in FIG. 10.
Figure 12:
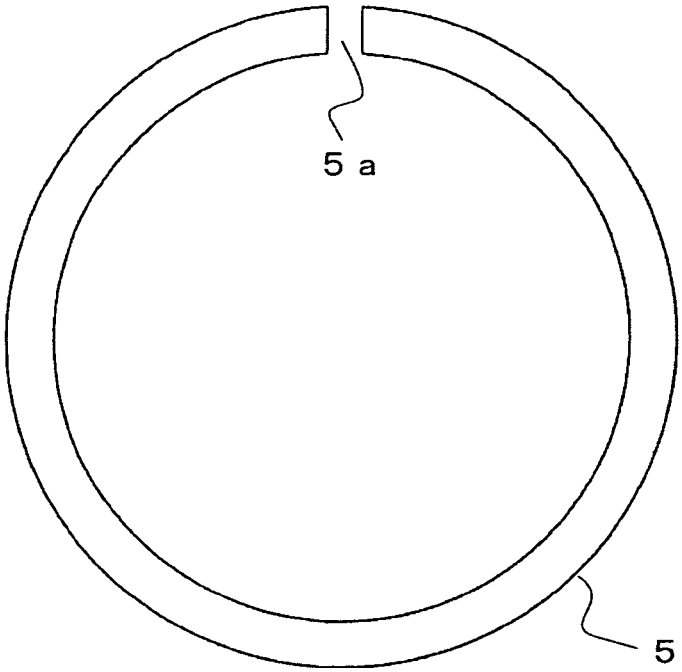
FIG. 12 is a front view showing an example the spacer used for the microphone unit shown in FIG. 10.

In this case, as expanded and shown in FIG. 2, the communication part for pressure equalization constituted by the grooves 16*a* and 16*c* communicates with the inner periphery side of the unit case 1, further communicates with the mesh-like spacer 14 side through the gap between inner periphery of the unit case 1 and the perimeter edge of the diaphragm holder 4 as shown by a dotted line arrow, thus being connected with the outside as with the example shown in FIG. 11.

It should be noted that the above-mentioned fixed electrode 6 is provided with a large number of communication holes 6*a* to allow communication between the arrangement side of the above-mentioned diaphragm 8 and the other side as shown in FIG. 3, and the arrangement side of the above-mentioned diaphragm 8 forms the rear space of the above-mentioned diaphragm 8 including the above-mentioned air room 11 at the opposite side.

Although the annular groove 16*c* is formed in the fixed electrode 6 in the first preferred embodiment illustrated in FIGS. 1 to 4 as described above, the annular groove 16*c* may not necessarily be provided in this example. When the straight line-like groove 16*a* reaching the perimeter edge of the fixed electrode 6 is provided, it can be operated as acoustic resistance for pressure equalization.

Figure 5:
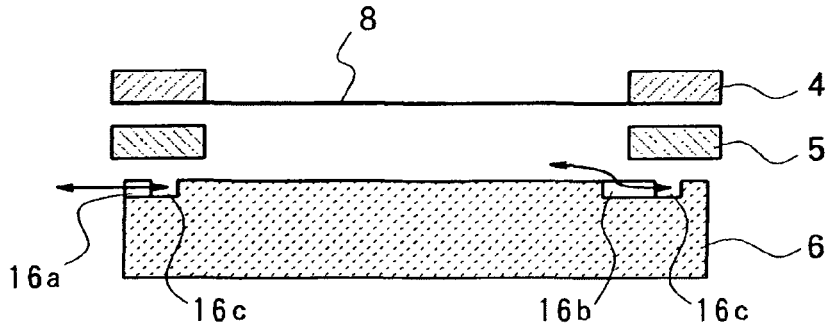
FIG. 5 is a schematic section showing a relationship between the fixed electrode and the diaphragm through the spacer in another arrangement.
Figure 6:
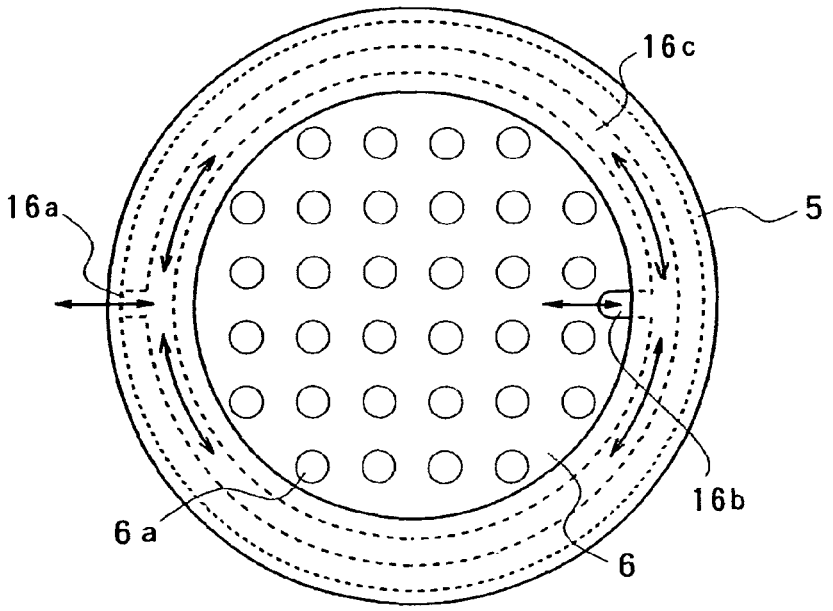
FIG. 6 is a front view showing a situation where the arrangement shown in FIG. 5 is viewed from the spacer side.

Next, a second preferred embodiment of the condenser microphone unit illustrated in FIGS. 5 and 6 shows an example in which the above-mentioned annular groove 16*c* is also operated as acoustic resistance for pressure equalization. That is, FIG. 6 shows an arrangement of the fixed electrode 6, viewed through and from above the ring-shaped spacer 5.

In this second preferred embodiment, the annular groove 16*c* is formed in the position which is covered with the above-mentioned spacer 5 and in the fixed electrode 6. Further, the first groove 16*a* and a second groove 16*b* are formed at 180 degrees diametrically opposed positions of the above-mentioned annular groove 16*c*.

That is, it is arranged that the above-mentioned groove 16*a* may communicate with the above-mentioned annular groove 16*c* and extend outwardly of the fixed electrode 6 and the above-mentioned second groove 16*b* may communicate with the above-mentioned annular groove 16*c* and extend inwardly of the fixed electrode 6.

It should be noted that the above-mentioned first groove 16*a*, the second groove 16*b*, and the above-mentioned annular groove 16*c* are formed by the half etching process already described.

Further, since the annular groove 16*c* is covered with the above-mentioned ring-shaped spacer 5, the acoustic resistance for pressure equalization can be provided over the whole circumference of the annular groove 16*c*.

FIG. 5 shows how the above-mentioned first groove 16*a* and second groove 16*b* communicate with the above-mentioned annular groove 16*c*.

The above-mentioned first groove 16*a* functions to allow the above-mentioned annular groove 16*c* to communicate with the outside as shown by the solid line arrow. The above-mentioned second groove 16*b* which is at the 180 degrees diametrically opposed position functions to allow the rear space between the above-mentioned diaphragm 8 and the fixed electrode 6 to communicate with the above-mentioned annular groove 16*c* as shown by the solid line arrow.

Therefore, according to the second preferred embodiment of the condenser microphone unit shown in FIGS. 5 and 6, the communication part formed of the above-mentioned annular groove 16*c* and the ring-shaped spacer 5 can effectively be operated as the acoustic resistance for pressure equalization for the non-directional microphone.

Also in the second preferred embodiment shown in FIGS. 5 and 6, they are mounted in the unit case 1 to form the above-mentioned condenser microphone unit as shown in FIG. 1.

FIG. 7 shows an example of the whole structure in which the above-mentioned microphone unit 1 is mounted in the front end of a cylindrical main case (microphone case) 21 to constitute the condenser microphone.

Figure 7B:
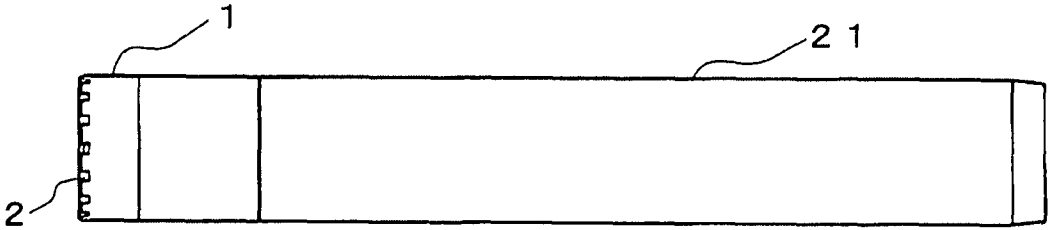
FIG. 7 are a front view, a side view, and a sectional view showing the whole arrangement of the condenser microphone in which the microphone unit is mounted in a main case of the microphone.
Figure 7C:
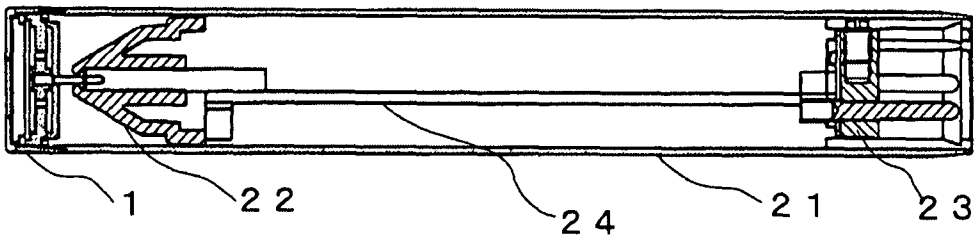
Figure 7A:
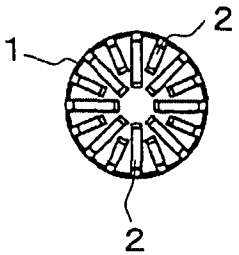

The above-mentioned microphone unit 1 is screwed into and mounted in the cylindrical main case 21 to have an appearance as shown in FIG. 7(A) in front view and in FIG. 7(B) in side view. As shown in FIG. 7(C) in sectional view, a support member 22 made of an insulating material and an output connector 23 are accommodated in the cylindrical main case 21. A circuit substrate 24 is supported between the support member 22 and the output connector 23.

FET as an impedance converter etc. is mounted on the above-mentioned circuit substrate 24. A signal through the pick-up electrode rod 9 which is on the above-mentioned microphone unit side is arranged to be subjected to signal processing including impedance conversion by the above-mentioned FET etc. to be outputted from the output connector 23.

What is claimed is:

1. A non-directional condenser microphone unit, comprising:

a diaphragm holder;

a diaphragm having a circumferential edge attached to the diaphragm holder;

an electrically insulating spacer disposed on the diaphragm at a side opposite to the diaphragm holder, and a fixed electrode made of a metal material and arranged to face said diaphragm at a predetermined interval through the electrically insulating spacer, the spacer being contacted with the fixed electrode, wherein a rear space of said diaphragm is closed, the rear space is communicated with an outside on a front surface side of the diaphragm through a communication part serving as acoustic resistance for pressure equalization, the communication part is formed between the spacer and a blind groove formed on the fixed electrode along a surface with which the spacer contacts and reaching an outer periphery of the fixed electrode, the blind groove includes an annular groove formed in an inner side of the fixed electrode, and extends from the annular groove to the outer periphery of the fixed electrode, one side of the communication part is communicated with the rear space and another side of the communication part is communicated with the outside of the fixed electrode at the outer periphery of the fixed electrode, and the communication part passing through the outside of the fixed electrode is communicated with the front surface side of the diaphragm through a gap formed between the holder and a unit case covering the outer side of the fixed electrode and an outer side of the holder.

2. A condenser microphone unit as claimed in claim 1, wherein said fixed electrode is provided with a communication hole which allows communication between a diaphragm arrangement side of said diaphragm and other side, closed air rooms interconnected through said communication hole are formed on the other side opposite the diaphragm arranged side of said fixed electrode, and the rear space of said diaphragm is arranged to include said air rooms.

3. A condenser microphone unit as claimed in claim 1, wherein the blind groove formed in said fixed electrode includes the annular groove formed in a position covered with said spacer, and a first groove and a second groove formed at 180 degrees diametrically opposed positions of said annular groove, the first groove extending outwardly from said annular groove and allowing communication between said annular groove and the outside, the second groove extending inwardly from said annular groove and allowing communication between said annular groove and the rear space of the diaphragm.

4. A condenser microphone, comprising:

the condenser microphone unit as claimed in claim 1 mounted in a microphone case.

5. A condenser microphone unit as claimed in claim 1, wherein a depth of the blind groove is 5 μm.

* * * * *